United States Patent [19]

Rozsas

[11] Patent Number: 4,709,681

[45] Date of Patent: Dec. 1, 1987

[54] FUEL INJECTION DEVICE

[75] Inventor: Tomas Rozsas, Wolfsburg, Fed. Rep. of Germany

[73] Assignee: Volkswagen AG, Wolfsburg, Fed. Rep. of Germany

[21] Appl. No.: 16,244

[22] Filed: Feb. 19, 1987

[30] Foreign Application Priority Data

Mar. 4, 1986 [DE] Fed. Rep. of Germany ..... 3606918

[51] Int. Cl.[4] ..... F01B 25/08

[52] U.S. Cl. ..... 123/531; 123/533

[58] Field of Search ..... 123/533, 531

[56] References Cited

U.S. PATENT DOCUMENTS

| | | | |
|---|---|---|---|
| 3,970,063 | 7/1976 | Mayr | 123/531 |
| 4,368,714 | 1/1983 | Emmenthal | 123/533 |
| 4,429,674 | 2/1984 | Lubbing | 123/533 |
| 4,543,939 | 10/1985 | Ehrhart | 123/533 |
| 4,554,945 | 11/1985 | McKay | 123/533 |
| 4,556,037 | 12/1985 | Wisdom | 123/533 |

FOREIGN PATENT DOCUMENTS

| | | | |
|---|---|---|---|
| 8600669 | 1/1986 | PCT Int'l Appl. | 123/531 |

*Primary Examiner*—Ronald B. Cox

*Attorney, Agent, or Firm*—Brumbaugh, Graves, Donohue & Raymond

[57] ABSTRACT

A device for injection of a two-phase mixture composed of fuel and carrier air into intake pipes associated with the individual cylinders of a multi-cylinder, mixture-compressing combustion engine, the device having carrier air apportioning means which apportions a carrier air current, branched off the intake manifold and conveyed by an air pump, to the injection lines associated separately with the individual cylinders of the combustion engine, a fuel injection valve is provided which injects the fuel by way of separate injection nozzles into the individual injection lines, the carrier air apportioning means is provided with a carrier air collecting space formed in a housing containing the injection valve, the collecting space surrounding the injection valve in annular manner and communicating, on the one hand, with the air pump and, on the other hand, with the injection lines, a carrier air reservoir is provided between the carrier air collecting space and the injection lines, which surrounds the injection valve in annular manner to ensure precise and uniform apportioning of carrier air to the individual cylinders, the carrier air reservoir cummunicating with the carrier air collecting space by means of a connecting line which is constricted in its cross section.

6 Claims, 4 Drawing Figures

FUEL INJECTION DEVICE

BACKGROUND OF THE INVENTION

The invention concerns a device for injection of a two-phase mixture composed of fuel and carrier air into the intake pipes associated with the individual cylinders of a multi-cylinder mixture-compressing combustion engine. The device having carrier air apportioning means which apportion a carrier air current, branched off an intake manifold and conveyed by an air pump, to injection lines separately associated with the individual cylinders of the engine and opening into the intake pipes thereof. Further provided is a fuel injection valve which injects the fuel, by way of separate injection nozzles, into the individual injection lines. The carrier air apportioning means is provided with a carrier air collecting space formed in a housing containing the injection valve. The collecting space surrounds the injection valve in an annular manner and communicates with the air pump and the injection lines.

Such a fuel injection device has already been proposed by a previous European PCT application. Contrary to other previously known fuel injection devices in accordance with which a two-phase mixture consisting of fuel and carrier air is injected into the intake pipes of multi-cylinder mixture-compressing combustion engines, the metering and apportioning of the fuel as well as the apportioning of the carrier air is obtained according to said application separately to the individual cylinders of the combustion engine prior to the mixing of the fuel with the carrier air. Thus, the difficult distribution of the fuel-carrier air mixture which was necessary in case of the heretofore known fuel injection devices in which the fuel was injected centrally and for all cylinders together into the carrier air line can be dispensed with.

However, in the fuel injection device proposed by the previous PCT application, the arrangement of the injection lines, in particular in the region of the zones situated ahead of the fuel delivery points in the direction of the flow, is still unfavorable in that a sufficiently precise apportioning of the carrier air to the individual injection lines is not possible without difficulty and, moreover, there is a risk that the fuel which is delivered will flow back, in opposition to the direction of flow of the carrier air, into the carrier air collecting space and will collect there in low-lying points.

SUMMARY OF THE INVENTION

Therefore, it is the purpose of the present invention to improve the proposed fuel injection device, in particular with respect to a precise carrier air apportioning to the individual injection lines. Moreover, a return flow of fuel in opposition to the direction of flow of the carrier air and a collection of the said fuel in the injection lines or the carrier air collecting space is to be largely avoided.

This purpose is attained by the present invention by providing a carrier air reservoir between the carrier air collecting space and the injection lines. The reservoir surrounds the injection valve in an annular manner, and communicates with the carrier air collecting space by means of a connecting line having a restricted cross section.

Due to the proposed interposition of a carrier air reservoir between the carrier air collecting space and the injection lines leading to the individual cylinders of the combustion engine, the carrier air afflux which, due to the preceding air pump occurs in a pulsating fashion, is rendered even to such an extent that the apportioning of the carrier air to the individual injection lines can be carried out very precisely and exactly. This is contributed to also by the connecting line, narrowed in its cross section, which is arranged between the carrier air collecting space and the carrier air reservoir, which line wards the pulsations coming from the air pump off the carrier air reservoir with which the injection lines are connected.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The drawing represents an exemplifying embodiment of the invention which will be explained in detail below.

DETAILED DESCRIPTION OF THE PREFERRED EMBODIMENTS

Figure 2:
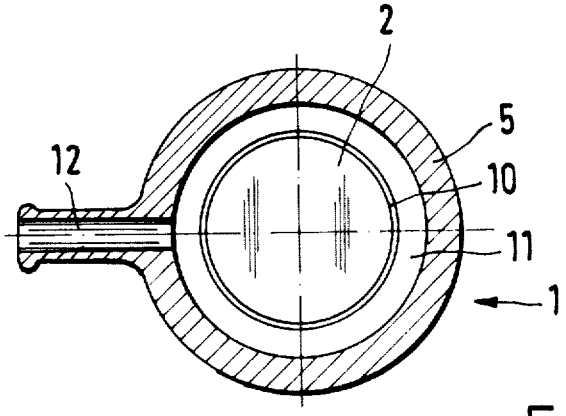
FIG. 2 represents a section through the lines II—II in FIG. 1.
Figure 3:
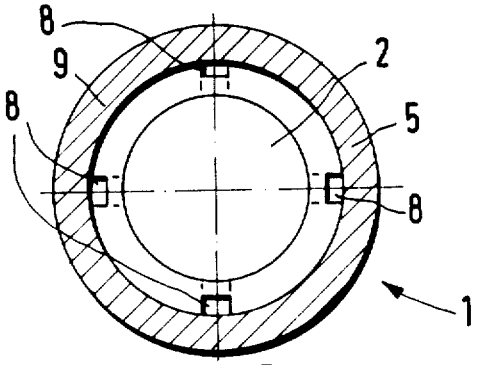
FIG. 3 represents a section through the lines III—III in FIG. 1.
Figure 4:
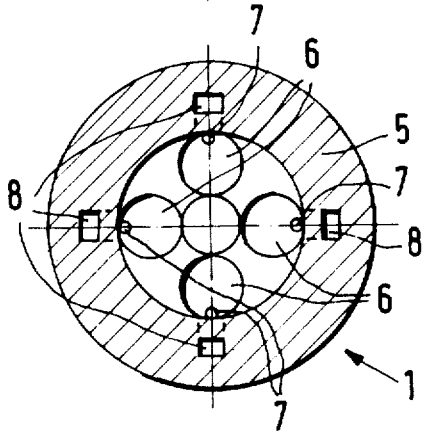
FIG. 4 represents a section through the lines IV—IV in FIG. 1.
Figure 1:
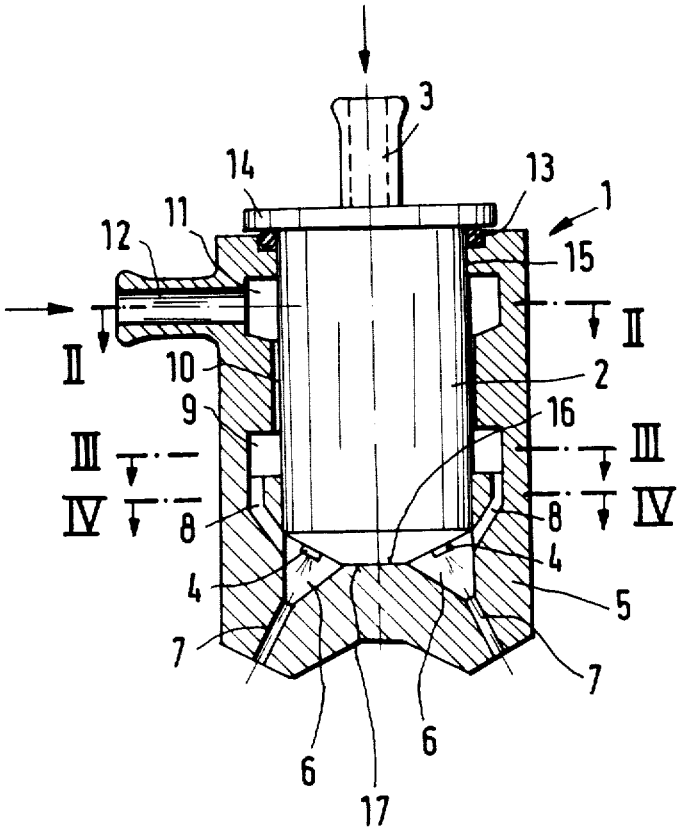
FIG. 1 shows a longitudinal section through a housing containing the injection valve and the carrier air apportioning device pursuant to the present invention.

In the drawing, -1- represents a metering and apportioning device for the fuel-carrier air mixture delivered to the individual cylinders of a conventional mixture-compressing combustion engine. The device includes a housing -5- which is, e.g., cylindrical and contains a fuel injection valve -2-. The fuel injection valve -2- is held in a center bore -15- of the housing -5- in such a manner that its end face -16- applies itself flush and tightly against the bottom -17- of the housing -5-. -13- designates an annular seal arranged below a flange -14- for sealing the housing bore -15- from the outside.

On its front end, the injection valve -2- is provided with a plurality, corresponding with the number of cylinders of the combustion engine, of injection nozzles -4-uniformly distributed over its circumference. The nozzles inject into corresponding mixing spaces -6- the fuel apportioned by the injection valve -2- as a function of the operating state of the combustion engine. The mixing spaces -6-are parts of injection lines -7-, -8- which are each associated with an individual cylinder of the combustion engine, and which convey the mixture of fuel and carrier air formed in the mixing spaces -6- to the injection points, not shown here, of the intake pipes associated with the individual cylinders of the combustion engine.

Prior thereto, the carrier air is taken from the joint intake manifold at a point which, seen in the direction of flow, is located behind an air quantity metering means, not shown here, forming part of the fuel injection device. A separate air pump conveys this carrier air current branched off the intake manifold to the metering and apportioning means -1- by way of a flexible hose line, likewise not shown here, connected, e.g., to the connecting sleeve -12-. The carrier air delivered flows then initially into a carrier air collecting space -11- arranged in the housing -5- and surrounding the injection valve -2- in an annular fashion. The collecting space -11- is connected by means of a connecting line -10-, reduced in its cross section, with a carrier air reservoir -9- which likewise surrounds the injection valve in an annular fashion. As shown in the drawing, the connecting line may be constituted by a throttle line also surrounding the injection valve -2- in annular fashion.

The injection lines -8- associated with the individual cylinders of the combustion engine branch off from the annular carrier air reservoir 9. The injection lines, whose number corresponds to the number of cylinders, are arranged in uniform distribution over the circumference of the device. In the exemplifying embodiment represented in the drawing, a four-cylinder combustion engine has been assumed, such as employed frequently, e.g., for the driving of passenger automobiles. Correspondingly, there are provided four injection lines -8- which are distributed uniformly over the circumference of the device and which lead ahead of the carrier air reservoir -9- essentially vertically downward, namely in the direction of the acceleration due to gravity, to four mixing spaces -6-, likewise distributed uniformly over the circumference of the device. The axes of the mixing spaces -6- which extend narrowingly in a cone shape in the direction of the flow, are slightly inclined outwardly relative to the center axis of the housing -5-, corresponding to the discharge direction of the injection nozzles -4- of the fuel injection valve -2-. The parts -7- of the injection lines joined with the mixing spaces -6- extend likewise in this direction, i.e., coaxial with the axes of the mixing spaces -6-.

As known, e.g., from the previous application or also from DE-OS No. 33 20 469, individual hose lines leading to the injection points of the intake pipes are also connected with the injection lines -7-.

It was already mentioned above that the injection lines -8- arranged in the direction of the flow ahead of the mixing spaces -6-, and passed through essentially only by carrier air, extend essentially continuously downward in the direction of acceleration due to gravity. Fuel delivered by the injection nozzles -4- is thereby prevented from flowing backward, which backward flow possibly is a result of pressure variations in the injection lines, with too much ease in opposition to the direction of flow of the carrier air. However, even if such should be the case at especially unfavorable pressure conditions, the proposed course of the carrier air lines which rise continuously starting at the mixing spaces -6- offers the advantage that there is no point where fuel can collect which during subsequent operating states could lead to non-uniform fuel deliveries to the individual cylinders.

The arrangement of the special carrier air reservoir -9- between the carrier air collecting space -11- which is directly connected with the air pump and the injection lines -8- leading to the mixing spaces -6- results, as mentioned above, in an advantageous smoothing of the carrier air afflux which is even enhanced by the throttle line -10- arranged between the carrier air collecting space -11- and the carrier air reservoir -9-. Thus, by means of the arrangement according to the invention, there is achieved a uniform and precise apportioning of the carrier air to the individual injection lines, so that the fuel metered-in by the injection nozzles is provided a more uniform conveyance to the injection points of the section pipes of the combustion engine.

While the invention has been illustrated and described as embodied in a fuel injection device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

1. A device for injection of a two-phase mixture composed of fuel and carrier air into intake pipes associated with individual cylinders of a multi-cylinder, mixture-compressing combustion engine, the device having carrier air apportioning means which apportions a carrier air current, branched off an intake manifold and conveyed by an air pump, to injection lines associated separately with the individual cylinders of the combustion engine and opening into the intake pipes thereof, and a fuel injection valve which injects fuel by way of separate injection nozzles into the individual injection lines, the carrier air apportioning means being provided with a carrier air collecting space formed in a housing containing the injection valve, said collecting space surrounding the injection valve in an annular manner so as to communicate, on the one hand, with the air pump and, on the other hand, with the injection lines, the device further comprising a carrier air reservoir provided between the carrier air collecting space and the injection lines so as to surround the injection valve in an annular manner, the carrier air reservoir communicating with the carrier air collecting space by means of a connecting line whose cross section is restricted.

2. A device as defined in claim 1, wherein said connecting line is formed as a throttle line provided so as to surround the injection valve in annular manner.

3. A device as defined in claim 1, wherein said injection lines are arranged so as to be uniformly distributed over the circumference of the housing.

4. A device as defined in claim 1, wherein said injection lines are provided with mixing spaces in the region of the injection nozzles of the injection valve which have a cone shape that narrows in the direction of flow.

5. A device as defined in claim 1, wherein parts of the injection lines which are situated ahead of the mixing spaces in the direction of the flow increase continuously starting at the mixing spaces.

6. A device for injection of a two-phase mixture composed of fuel and carrier air into intake pipes associated with individual cylinders of a multi-cylinder, mixture compressing combustion engine having an intake manifold and an air pump, the device comprising:

a housing;

carrier air apportioning means for apportioning a carrier air current branched off the intake manifold and conveyed by the air pump to injection lines separately associated with individual cylinders of the engine and opening into the intake pipes; and a fuel injection valve provided in said housing and having a separate injection nozzle for each of the injection lines so that fuel is injectable into said lines, said carrier air apportioning means being provided with a carrier air collecting space formed in said housing, said carrier air collecting space being formed so as to surround said injection valve in an annular manner and communicate with the air pump and the injection lines, a carrier air reservoir being provided in said housing between the carrier air collecting space and the injection so as to surround said injection valve in an annular manner, and a connecting line having a restricted cross section being provided so as to connect the carrier air reservoir with the carrier air collecting space.

* * * * *

UNITED STATES PATENT AND TRADEMARK OFFICE

CERTIFICATE OF CORRECTION

PATENT NO. : 4,709,681

DATED : December 1, 1987

INVENTOR(S) : Tomas Rozsas

It is certified that error appears in the above-identified patent and that said Letters Patent is hereby corrected as shown below:

Title page:

Item [56], References Cited, under "4,556,037 12/1985 Wisdom..... 123/533" add --4,519,370 5/1985 Iwata ..... 123/533--.

Signed and Sealed this

Twenty-eighth Day of June, 1988

*Attest:*

*Attesting Officer*

DONALD J. QUIGG

*Commissioner of Patents and Trademarks*